US009320102B2

(12) United States Patent
Nieberlein et al.

(10) Patent No.: US 9,320,102 B2
(45) Date of Patent: Apr. 19, 2016

(54) LED LIGHTING DEVICE WITH MODELLING DEVICE FOR MODELLING A VOLTAGE PROFILE

(71) Applicant: Diehl Aerospace GmbH, Ueberlingen (DE)

(72) Inventors: Uwe Nieberlein, Roth (DE); Jens Jordan, Nuremberg (DE)

(73) Assignee: DIEHL AEROSPACE GMBH, Ueberlingen (DE)

( * ) Notice: Subject to any disclaimer, the term of this patent is extended or adjusted under 35 U.S.C. 154(b) by 0 days.

(21) Appl. No.: 14/687,307

(22) Filed: Apr. 15, 2015

(65) Prior Publication Data

US 2015/0296585 A1 Oct. 15, 2015

(30) Foreign Application Priority Data

Apr. 15, 2014 (DE) ..... 10 2014 005 582

(51) Int. Cl.
*H05B 37/02* (2006.01)
*H05B 33/08* (2006.01)

(52) U.S. Cl.
CPC ..... *H05B 33/0845* (2013.01); *H05B 33/0809* (2013.01); *H05B 37/02* (2013.01)

(58) Field of Classification Search
CPC ..... H05B 33/0827; H05B 37/02
USPC ..... 315/185 R, 192, 291, 307, 308
See application file for complete search history.

(56) References Cited

U.S. PATENT DOCUMENTS

| | | | | |
|---|---|---|---|---|
| 8,384,311 | B2 * | 2/2013 | Gray | H05B 33/0824 315/185 R |
| 9,006,985 | B2 * | 4/2015 | Lin | H05B 33/0812 315/127 |
| 2013/0257300 | A1 | 10/2013 | Nieberlein et al. | |
| 2013/0257310 | A1 | 10/2013 | Nieberlein et al. | |
| 2014/0159616 | A1 * | 6/2014 | Wang | H05B 33/0845 315/307 |

FOREIGN PATENT DOCUMENTS

| | | | |
|---|---|---|---|
| DE | 102011003931 | A1 | 8/2012 |
| DE | 102012006315 | A1 | 10/2013 |
| DE | 102012006316 | A1 | 10/2013 |
| DE | 102012006341 | A1 | 10/2013 |
| DE | 102012006343 | A1 | 10/2013 |
| WO | WO 2010/013172 | A1 | 2/2010 |
| WO | WO 2013/069843 | A1 | 5/2013 |

OTHER PUBLICATIONS

English Abstract of WO 2012/107293 A2, dated Aug. 16, 2012.

* cited by examiner

*Primary Examiner* — Tung X Le
(74) *Attorney, Agent, or Firm* — Scully Scott Murphy and Presser

(57) ABSTRACT

An LED lighting device for supplying a main voltage by an AC power supply is provided. The device has a rectifier for producing a rectified AC voltage from the main voltage, an LED light unit having multiple of LEDs and a circuit arrangement, and a control device for controlling the circuit arrangement. The circuit arrangement switches the LEDs to different circuit states, in which the LED light unit has different forward voltages. The control device controls the circuit arrangement, in such a way that the forward voltage of the LED light unit is adjusted to the voltage profile of the rectified AC voltage. The device also has a modelling device for modelling a modelled voltage profile. The control device controls the circuit states based on the modelled voltage profile. The modelled voltage profile is modelled based on measured variables for describing the real voltage profile of the main voltage.

12 Claims, 5 Drawing Sheets

LED LIGHTING DEVICE WITH MODELLING DEVICE FOR MODELLING A VOLTAGE PROFILE

BACKGROUND OF THE INVENTION

The present invention relates to an LED lighting device having the features of the preamble of Claim 1.

DISCUSSION OF THE PRIOR ART

Compared to systems having conventional lighting means such as incandescent bulbs or halogen lights, LED lights have the advantage of converting a very high proportion of the consumed power into visible light, thus functioning in a highly efficient manner. As a result, LED lights produce little waste heat, making it possible for them to have a highly compact design. On the other hand, in comparison to incandescent bulbs, LED lights are significantly more demanding with respect to the power supply. Here, it must be ensured that the operating voltage is maintained, since the LED lights do not function if the operating voltage is too low, and are damaged if the operating voltage is too high. In light of this, it is common to control LED lights using a voltage source having a constant output voltage. In the event that an AC voltage is present as a supply voltage, LED lights thus require a power supply which converts the AC voltage into a constant operating voltage.

Another approach is implemented in the applications DE 10 2012 006 315 A1, DE 10 2012 006 316 A1, DE 10 2012 006 341 A1 and DE 10 2012 006 343 A1. These publications describe LED arrangements which each include a plurality of LEDs, in which it is possible to connect the LEDs to each other in a flexible manner, so that the LEDs as a whole may achieve different forward voltages. A rectified AC voltage is fed as a supply voltage to these LED arrangements, a control device ensuring that the LED arrangement assumes a circuit state having a forward voltage which corresponds to an instantaneous voltage value of the supply voltage. In this way, it is possible to operate the LED arrangement using a rectifier circuit at an AC power supply, but without a switching power supply.

SUMMARY OF THE INVENTION

The object of the present invention is to provide an LED lighting device for an AC power supply which emits particularly uniform light, in particular for the human viewer.

Within the scope of the present invention, an LED lighting device is provided which is designed to be supplied by an AC power supply, wherein the LED lighting device is supplied with a mains voltage of the AC power supply. The mains voltage is thus implemented as an AC voltage. The AC power supply may, for example, be a public electrical network having an effective mains voltage of 230 volts and a mains frequency of 50 hertz. The AC power supply particularly preferably has an effective voltage between 100 volts and 150 volts, in particular 115 volts, and a mains frequency between 100 hertz and 800 hertz, in particular between 150 hertz and 400 hertz. The AC power supply is particularly preferably provided in an aeroplane. The aeroplane including the AC power supply and the lighting device optionally form additional subject matter of the present invention.

The LED lighting device comprises a rectifier device which produces, in particular rectifies, a rectified AC voltage from the mains voltage, as a supply voltage having a supply current. The rectifier device may, for example, be a bridge circuit. The mains voltage is particularly preferably designed as a sinusoidal voltage; in alternative specific embodiments, it may also be a distorted sinusoidal voltage or another alternating AC voltage as a mains voltage. The rectified AC voltage particularly preferably has regularly repeating, preferably sinusoidal half-waves.

The LED lighting device comprises at least one LED light unit; however, multiple LED light units may be provided. The, some, or all LED light units each comprise a plurality of LEDs and, optionally jointly or each individually, a circuit arrangement. The LEDs are designed as light-emitting diodes and may be designed uniformly white or may emit different colours, in particular red, green and blue, as light colours. Overall, the LED light unit may emit a white light or a coloured light, in particular mixed-colour light.

The circuit arrangement is designed to interconnect the LEDs of the LED light unit in different circuit states, wherein the LED light unit has different forward voltages in the different circuit states. The different forward voltages of the circuit states are achieved by the LEDs of the LED light unit being connected in series or in parallel to each other as a function of the circuit state, in order to change the forward voltage. Particularly preferably, the LED light unit may assume at least two circuit states having forward voltages not equal to 0 volts. For example, if two LEDs, each having a forward voltage of 3.4 volts, are connected in series, the collective forward voltage is 6.4 volts. If they are connected in parallel, the forward voltage is only 3.4 volts. According to this system, the LEDs may be connected in parallel and in series, also in subgroups, in order to achieve the different forward voltages. In addition, it is optionally possible that the circuit states are designed to generate certain mixed colours of the LED light unit.

Particularly preferably, the LED light unit has at least two, preferably at least three, in particular at least four, different circuit states, each having different forward voltages of the LED light unit. In particular, the LED light unit is designed having the circuit arrangement as described in the application publications DE 10 2012 006 315 A1, DE 10 2012 006 316 A1, DE 10 2012 006 341 A1 and DE 10 2012 006 343 A1 by the applicant.

The LED lighting device comprises a control device which is designed for controlling the LED light unit, in particular for controlling the circuit arrangement of the LED light unit. The control device is designed to control the LED light unit, in particular the circuit arrangement, in such a way that, as a result, the forward voltage of the LED light unit is adjusted to the voltage profile, in particular to the instantaneous value of the rectified AC voltage. The control is in particular carried out in such a way that the LEDs are operated within their operating window. This is in particular achieved by the LED light unit, in particular the circuit arrangement, being controlled at least two times, preferably four times, per half-wave, to change the circuit state and thus the forward voltage.

In the scope of the present invention, it is provided that the LED lighting device includes a modelling device for modelling a modelled voltage profile. The modelled voltage profile forms the basis for the control device to control the circuit states. The modelled voltage profile thus forms a reference variable for controlling the circuit arrangement via the control device.

The modelled voltage profile is modelled based on measured variables for describing the real voltage profile. Measured variables are thus tapped at the LED lighting device, which describe the real voltage profile of the mains voltage either directly or indirectly.

The modelled voltage profile is modelled based on these measured variables, in particular, a model of the voltage profile is adjusted, so that the modelled voltage profile corresponds to the real voltage profile or is at least consistent with the real voltage profile of the mains voltage. For example, it is possible that the mains voltage is modelled; alternatively or in addition, it is possible that the rectified mains voltage is modelled.

Here, one consideration of the present invention is that the frequency, phase position or amplitude of the mains voltage may fluctuate or may be disturbed, in particular when using an AC power supply in an aeroplane. Such deviations may, for example, result from fluctuations in rotational speeds of generators, the sudden activation or deactivation of loads, etc. If the mains voltage or the rectified mains voltage is now used as a reference value in the control device for controlling the circuit states, firstly, the controller must be designed to be very fast, and secondly, such disturbances may cause the LEDs to flicker.

In contrast, the present invention provides for using a modelled voltage profile, wherein a priori knowledge about the voltage profile may be used in the modelled voltage profile. Thus, use may be made of the fact that it is known that the mains voltage is formed as a sinusoidal voltage, in which case the modelled voltage profile must also be based on a sinusoidal profile. Thus, only the amplitude, the phase position and the frequency must be aligned as determining parameters in the modelled voltage profile. However, these determining parameters of the modelled voltage profile may be adjusted in a simple manner by tapping the measured variables for describing the real voltage profile. With knowledge of the modelled voltage profile, an additional advantage results from the fact that it is possible to "plan into the future", since knowledge of the phase position, frequency and amplitude at the start of a half-wave makes it possible to infer the end of the half-wave with high reliability. The creation and use of the modelled voltage profile thus makes it possible to improve the control of the LED light unit, in particular of the circuit arrangement, so that, even in the event of instability in the AC power supply, the control may be carried out with high planning reliability, and as a result, the light emission by the LED lighting device may occur more homogeneously from a temporal point of view.

In principle, it is possible that the modelling device and/or control device are designed as an analogue circuit. However, it is preferred that the LED lighting device comprises a digital data processing device, for example, a microcontroller, wherein the modelling device is designed as a program, in particular as a program part. The modelling of the modelled voltage profile is carried out in particular based on a digital signal processing of the measured variables. The use of a digital data processing device makes it possible to program the modelling device flexibly, so that all modern signal processing and modelling techniques may be used. Optionally, the control device is also implemented as a program, in particular a program module, in the digital data processing device.

In one preferred embodiment of the present invention, the modelling device comprises a calculation module, wherein the calculation module is designed for calculating an actual phase angle of the real voltage profile of the mains voltage. The phase angle is, for example, designed for 360 degrees per period, wherein a phase angle between 0 and 360 degrees is determined. In particular, the calculated actual phase angle is provided having a delay of less than 1 millisecond with respect to the real voltage profile.

In one preferred embodiment of the present invention, the calculation module is designed as a space vector module, wherein the actual phase angle is depicted as a space vector. In one preferred refinement of the present invention, the space vector module is designed for determining the space vector, in that the space vector is formed from the signal profile of the real voltage profile of the mains voltage as a first signal profile and a second signal profile which is phase-shifted with respect to it, wherein the phase-shifted second signal profile is derived from the first signal profile or corresponds to it, having a phase shift.

Particularly preferably, the second signal profile is formed as the first signal profile having a phase shift. Particularly preferably, the phase shift is 90°, so that the space vector may be calculated in a simple manner from the first and the second signal profile. The second signal profile may in particular be produced by applying an integrator to the first signal profile. By jointly evaluating the two signal profiles offset from each other by a phase shift, it is possible to infer the actual phase angle of the real voltage profile unambiguously, in particular in the range from 0° to 360°. The use of the integrator is preferred in comparison to the use of a differentiator, since it attenuates or integrates disturbances in the first signal profile at the same time.

In one possible embodiment of the present invention, in addition to the actual phase angle, the amplitude of the real voltage profile of the mains voltage is calculated in the calculation module and forms the length of the space vector.

In one preferred embodiment of the present invention, the LED lighting device, in particular the digital data processing device, specifically the microcontroller, has two analogue-digital interfaces, wherein the analogue-digital interfaces are each connected to a conductor of the mains voltage, and tap the two phases of the mains voltage as measured variables for describing the real voltage profile. The tapped measured variables jointly form the signal profile of the real voltage profile of the mains voltage and are thus suitable for describing the real voltage profile of the mains voltage.

Particularly preferably, the rectified AC voltage downstream of the rectifier device is used as a reference potential of the two analogue-digital interfaces. By using the reference potential downstream of the rectifier device, the half-waves are measured in an alternating manner by the two analogue-digital interfaces, in which case the real voltage profile of the mains voltage may be ascertained by an addition of the measured signal profiles.

In one particularly preferred refinement of the present invention, the modelling device includes an oscillator module which is designed to produce the modelled voltage profile, and a correction module which is designed to compare the phase angle of the modelled voltage profile with the actual phase angle, and optionally in addition, to compare the amplitude of the modelled voltage profile with the amplitude in the signal profile of the real voltage profile of the mains voltage, and as a result, to generate an error signal which is fed back to the oscillator module for correction and corrects the modelled voltage profile there. In particular, the modelling device corresponds to a phase-locked loop (PLL) for modelling the modelled voltage profile. However, it is preferably provided that a plurality of synchronization points between the actual phase angle, in particular depicted as the space vector, and the modelled phase profile, is used per full wave. As a result, the controller is able to respond to changes or disturbances in the AC power supply very rapidly, in particular at a frequency higher than the frequency of the AC power supply.

In one preferred refinement of the present invention, the LED lighting device comprises a current sink device which is designed for controlling an LED current through the LED light unit. In terms of circuitry, the current sink device is connected in series with at least the one LED light unit. The supply voltage, in particular the rectified AC voltage, is present at the current sink device and the LED light unit. In particular, the current sink device is designed to convert electric power into heat in order to adjust the LED current. In addition, the control device is designed to control the current sink device in such a way that the LED current is adjusted to an instantaneous value of the modelled voltage profile and thus to the real voltage profile of the AC voltage.

The adjustment of the LED current is carried out in such a way that the LED current is set such that the time profile of the supply current is synchronized with the time profile of the real voltage profile of the AC voltage and/or mains voltage. By checking, in particular controlling or regulating, the current sink device, it may in particular be made possible to achieve a power factor greater than 0.98, preferably greater than 0.99, for the LED lighting device.

In one preferred embodiment of the present invention, the control device is designed to control the LED light unit, in particular the circuit arrangement, in such a way that a circuit state having a forward voltage of the LED light unit is activated, wherein the forward voltage of the selected circuit state is less than or equal to the instantaneous value of the modelled voltage profile and/or the voltage profile of the rectified AC voltage. In this way, it is ensured that the LEDs of the LED light unit do not become dimmer in the event of an undershooting of the instantaneous value of the rectified AC voltage of the instantaneous current forward voltage.

Particularly preferably, it is even provided that the circuit state is continuously activated which has the highest forward voltage, which is less than or equal to the instantaneous value of the modelled voltage profile and/or the instantaneous value of the real voltage profile of the rectified AC voltage.

BRIEF DESCRIPTION OF THE DRAWINGS

Additional features, advantages and effects of the present invention result from the following description of a preferred exemplary embodiment of the present invention and the included figures.

DETAILED DESCRIPTION OF THE INVENTION

Figure 1:
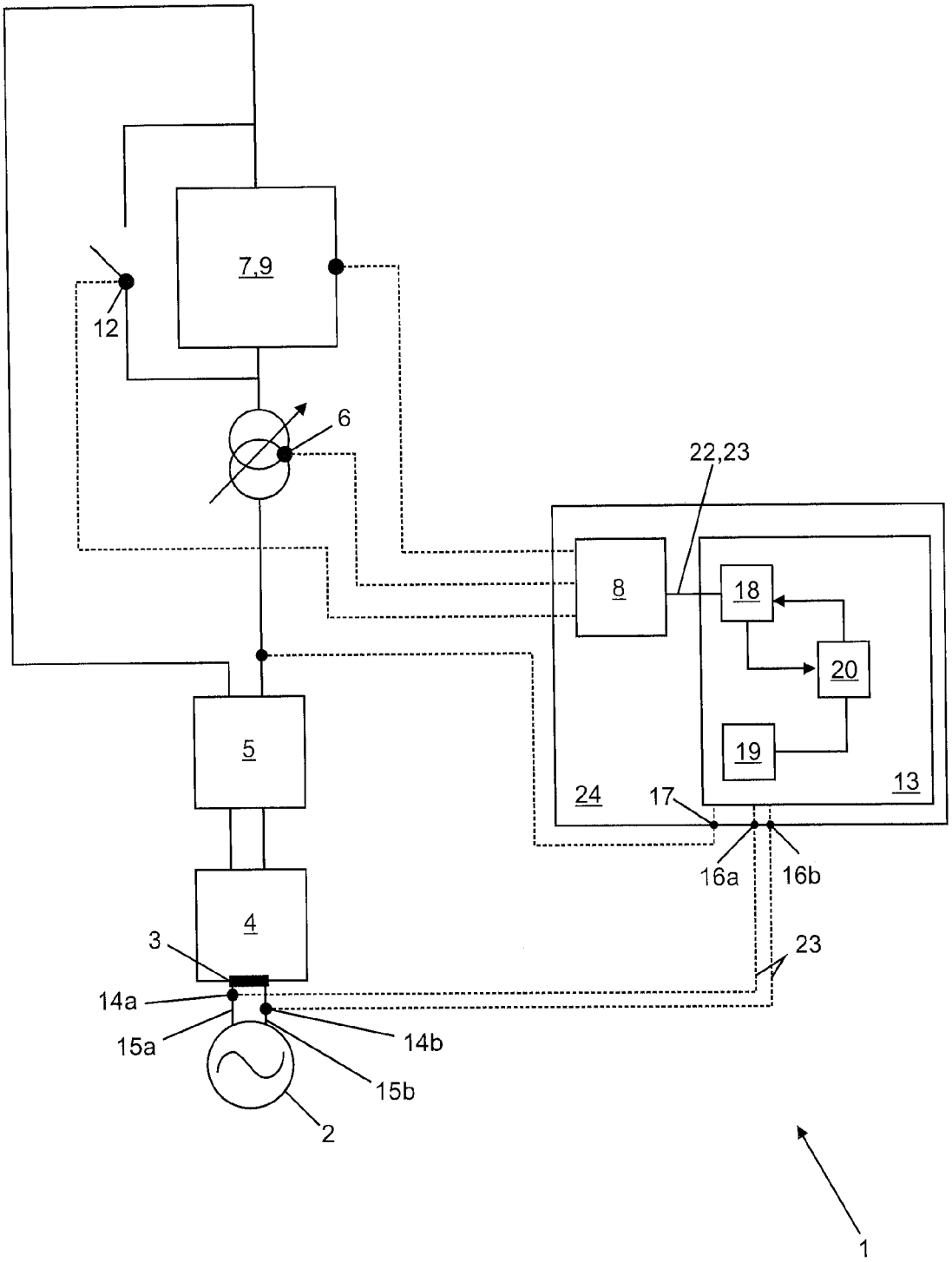
FIG. 1 shows a schematic block diagram of an LED lighting device as an exemplary embodiment of the present invention.

FIG. 1 shows an LED lighting device 1 in a schematic block diagram which may be or is situated in an aeroplane as passenger compartment lighting, as a first exemplary embodiment of the present invention. The aeroplane provides an AC power supply 2 having an AC voltage as the mains voltage. This effective voltage of the AC voltage is, for example, 115 volts; the frequency of the AC power supply 2 is between 150 hertz and 400 hertz.

A mains filter 4 is optionally downstream of a connection interface 3, which is designed to filter disturbances which could be fed back to the AC power supply 2.

A rectifier 5 is downstream of the mains filter 4, which is designed to convert the applied AC voltage or the filtered AC voltage into a rectified AC voltage as a supply voltage 11.

The rectifier 5 is, for example, designed as a bridge rectifier. The rectified AC voltage is formed as a pulsing DC voltage having half-waves, in particular having twice the frequency of the AC power supply 2. For example, the rectified AC voltage is formed as a supply voltage 11 via a concatenation of sinusoidal half-waves having twice the frequency of the AC power supply 2.

The rectified AC voltage provided by the rectifier 5 is subsequently transmitted as a supply voltage 11 to a current sink device 6, also referred to as an electronic load Similarly, a corresponding supply current is transmitted.

The current sink device 6 is designed, regulated, or controlled to withdraw current and thus power from the circuit via conversion into heat. Based on the current sink device 6, an LED voltage and an LED current are transmitted to an LED light unit 7 including a plurality of LEDs.

In addition, the LED lighting device 1 comprises a control device 8, which, as shown here, may be formed as one part or alternatively as multiple parts, and which is designed at least for controlling the LED light unit 7 and the current sink device 6. The control device 8 may, for example, be designed as a program module in a programmable microcontroller as a digital data processing device 24.

The LED light unit 7 is switchable to different circuit states via the control device 8, in order to be able to respond to different instantaneous values of the rectified AC voltage as a supply voltage 11. For this purpose, the LED light unit has a circuit arrangement 9 whose function is described based on FIGS. 2A, 2B, 2C.

Figures 2A, 2B, 2C:
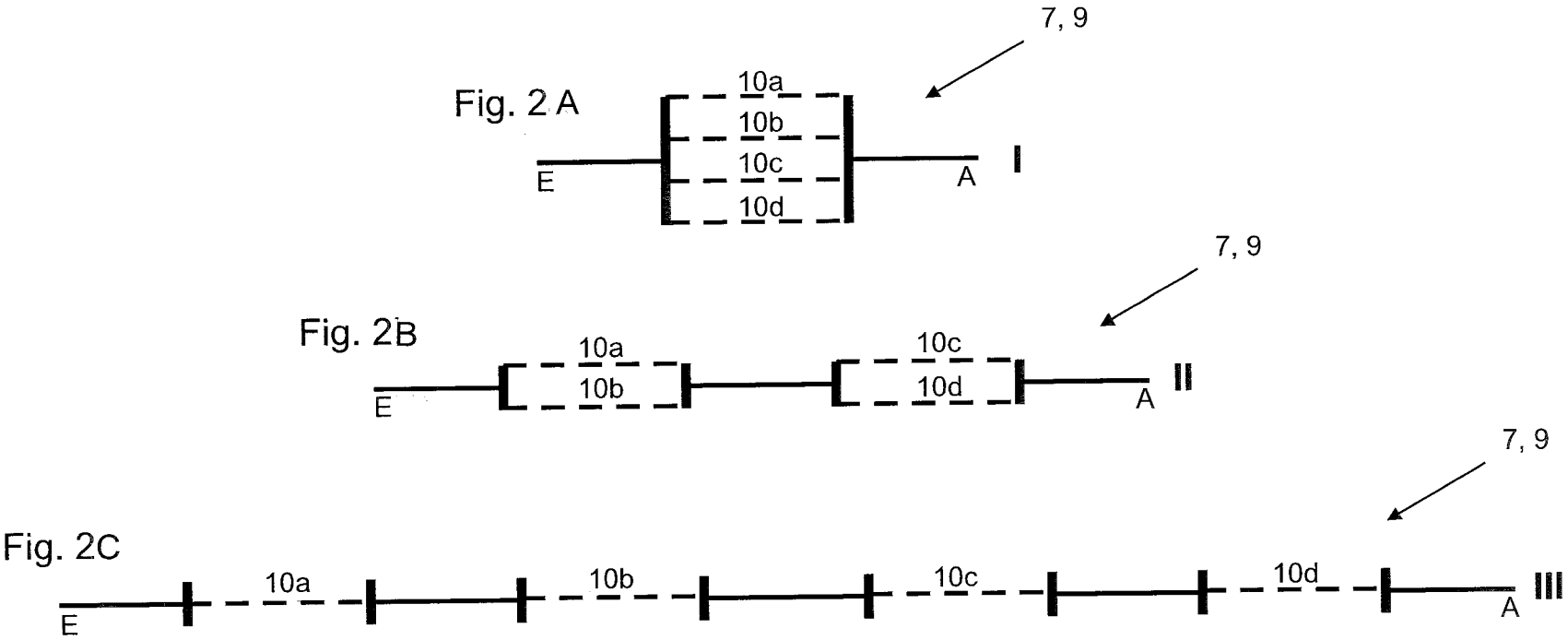
FIGS. 2A, 2B, 2C show a schematic block diagram of the LED light unit as a detail of the LED lighting device in FIG. 1.

FIG. 2A shows the LED light unit 7 having the circuit arrangement 9 in a highly schematized depiction. The LED light unit 7 includes an input E and an output A, or a first and second terminal, via which the LED light unit 7 is connected to the power supply shown in FIG. 1.

In this example, the LED light unit 7 comprises four LED subgroups 10*a, b, c, d*, wherein each LED subgroup 10*a, b, c, d* includes at least one LED. In particular, each LED subgroup 10*a, b, c, d* has the same forward voltage. As depicted symbolically in FIGS. 2A, 2B, 2C, the LEDs in the LED subgroups 10*a, b, c, d* may be connected to each other in series in each of the LED subgroups 10*a, b, c, d*. In modified exemplary embodiments, the LEDs in the LED subgroups 10*a, b, c, d* may also be connected to each other in parallel, in series, or in parallel and in series in a mixed manner In this exemplary embodiment, each LED subgroup 10*a, b, c, d* has the same forward voltage. In the first circuit state I of the LED light unit 7 shown in FIG. 2A, the four LED subgroups 10*a, b, c, d* are arranged electrically in parallel to each other, so that the forward voltage of the LED light unit 7 corresponds to the forward voltage of one of the LED subgroups 10*a, b, c, d*.

In FIG. 2B, a second circuit state II is depicted, wherein the LED subgroups 10*a, b, c, d* in the LED light unit 7 are only partially electrically connected to each other in series. For example, it is provided that in the first group, the LED subgroups 10*a, b* are arranged in parallel to each other, and in the second group, the LED subgroups 10*c, d* are likewise arranged in parallel to each other; however, the two groups are arranged in series to each other. In the circuit state II, the forward voltage of the LED light unit 7 now corresponds to twice the forward voltage of one of the LED subgroups 10*a, b, c, d.*

In FIG. 2C, a third circuit state III is depicted, wherein all four LED subgroups 10*a, b, c, d* are now arranged electrically in series. The forward voltage of the LED light unit 7 now corresponds to four times the forward voltage of one of the LED subgroups 10*a, b, c, d.*

The circuit arrangement 9 is designed to switch the LED light unit 7 to the different circuit states I, II, III. A corresponding circuit arrangement 9 for this type of switchover may, for example, be implemented with the aid of diodes and transistors.

However, the kind of switchover to various circuit states is not limited to the described example, but may also be achieved via other circuit arrangements, for example, the LED lighting devices mentioned in the introduction. It is also possible that the LED subgroups 10 *a, b, c, d* are deactivated in the circuit states. It is also possible that a mixed light is produced via LED subgroups having different colours.

Figure 3:
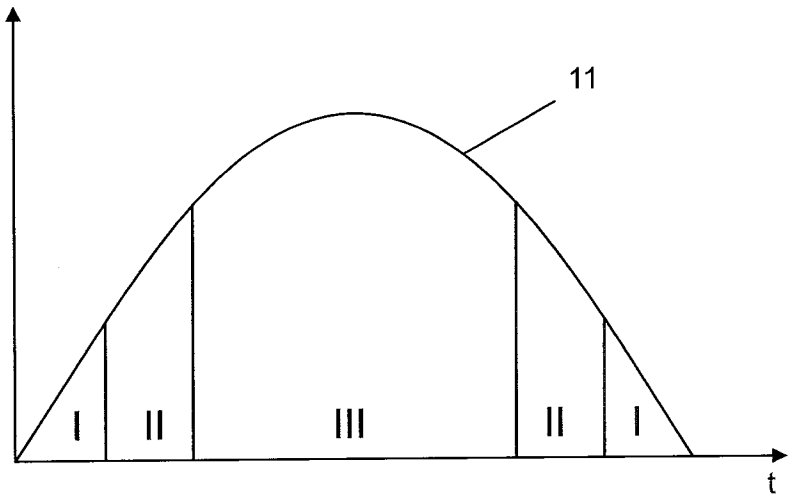
FIG. 3 shows a schematic diagram of the voltage profile of a half-wave of the rectified AC voltage for explaining the control of the circuit states of the LED lighting device in FIG. 1 or the LED light unit in FIGS. 2A, 2B, 2C.

FIG. 3 shows a highly schematized half-wave of the supply voltage 11, in which it is depicted that the circuit states I, II, III of the LED light unit 7 are continuously selected in such a way that the forward voltage is less than an instantaneous value of the supply voltage 11. On the other hand, the LED light unit 7 is always set to the circuit state I, II, III which has the maximum forward voltage, in order to minimize power losses.

In addition, the LED lighting device 1 includes a short-circuit switching device 12 for bridging the LED light unit 7, wherein the short-circuit device 12 is activated if the instantaneous value of the supply voltage 11 is less than the forward voltage of the circuit state having the minimum forward voltage. The short-circuit switching device 12 is thus activated at the start and at the end of the half-wave.

Without additional actions, the LED current and, as a result, the supply current, and finally, the mains current, would result in a mains current profile which is characterized by inhomogeneities and spikes due to the switchover processes in the LED light unit 7. However, in order to achieve a high power factor greater than 0.99, the control device 8 controls the current sink device 6 in such a way that the supply current, and thus the mains current, flows synchronously to the supply voltage 11 or synchronously to the AC voltage or mains voltage. In particular, in a closed short-circuit switching device 12, the current sink device 6 is controlled to convert current and thus power into heat, in order to keep the power factor high.

To generate a reference value for controlling the circuit states of the LED light unit 7, the LED lighting device 1 includes a modelling device 13 which is likewise implemented as a program module in the digital data processing device 24. The modelling device 13 is designed for modelling a modelled or synthetic voltage profile 22, 23 (FIG. 5), wherein the control device 8 controls the circuit states based on the modelled voltage profile 22, 23. The modelled voltage profile 22, 23 is modelled based on measured variables for describing the real voltage profile 21 of the mains voltage of the AC power supply 2. For tapping the measured variables and thus the real voltage profile 21, this real voltage profile 21 is tapped via two measuring points 14*a, b* at the two conductors 15*a, b* of the AC power supply 2. The electrical signals are digitized via two analogue-digital interfaces 16*a, b* in the digital data processing device 24. In this exemplary embodiment, the potential is tapped at one output of the rectifier 5 as a reference potential and supplied via another interface 17 of the digital data processing device 24. By internally processing the signal profile of the reference potential via the interface 17 and the signal profiles at the conductors 15*a, b* of the AC power supply 2 to the analogue-digital interfaces 16*a, b*, the real voltage profile 21 of the mains voltage, i.e., the AC voltage, may be determined in the digital data processing device 24 in a simple manner.

An oscillator module 18, which is also designed as a program module, is situated in the modelling device 13. It provides the modelled voltage profile 22, 23 as a sinusoidal function or rectified sinusoidal function. For adjusting the modelled voltage profile 22, 23, the modelling device 13 includes a calculation module 19 in which an actual phase angle of the real voltage profile 21 of the mains voltage is calculated in real time. In addition, an amplitude of the real voltage profile 21 of the mains voltage is ascertained.

At least the actual phase angle, possibly supplemented by the amplitude, is transmitted to a correction module 20 in the modelling device 13, which is also designed as a program module and is compared there with the phase angle of the modelled voltage profile 22, 23 and its amplitude. Based on the comparison, an error value is determined as an error signal, which is transmitted to the oscillator module 18 in order, as a correction value, to align the modelled voltage profile 22, 23 with the real voltage profile 21 of the mains voltage.

Figure 4:
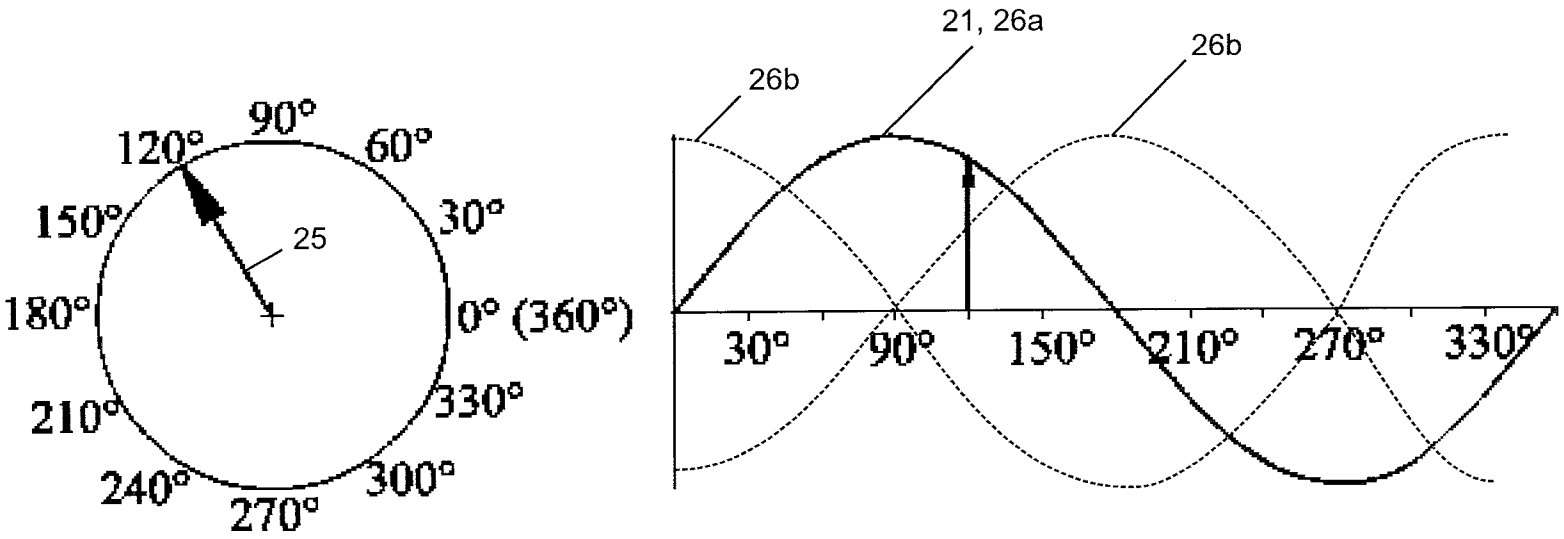
FIG. 4 shows a schematic representation of the functionality of the space vector model for determining the actual phase angle of the mains voltage.

The calculation of the actual phase angle of the real voltage profile 21 of the mains voltage is illustrated in FIG. 4 and is carried out via a space vector model having a space vector 25, wherein the space vector 25 is formed and/or calculated via two signal profiles 26*a, b*, which, in this example, are offset from each other by 90°. A first signal profile 26*a* represents the real voltage profile 21; the second signal profile 26*b* is offset from it by minus or plus 90 degrees and is calculated in the calculation module 19 through the use of an integrator or a differentiator based on the signal profile 26*a* of the real voltage profile 21. Via the two signal profiles 26*a, b*, the actual phase angle of the space vector 25 may be calculated unambiguously within a 360-degree period in a simple manner.

Figure 5:
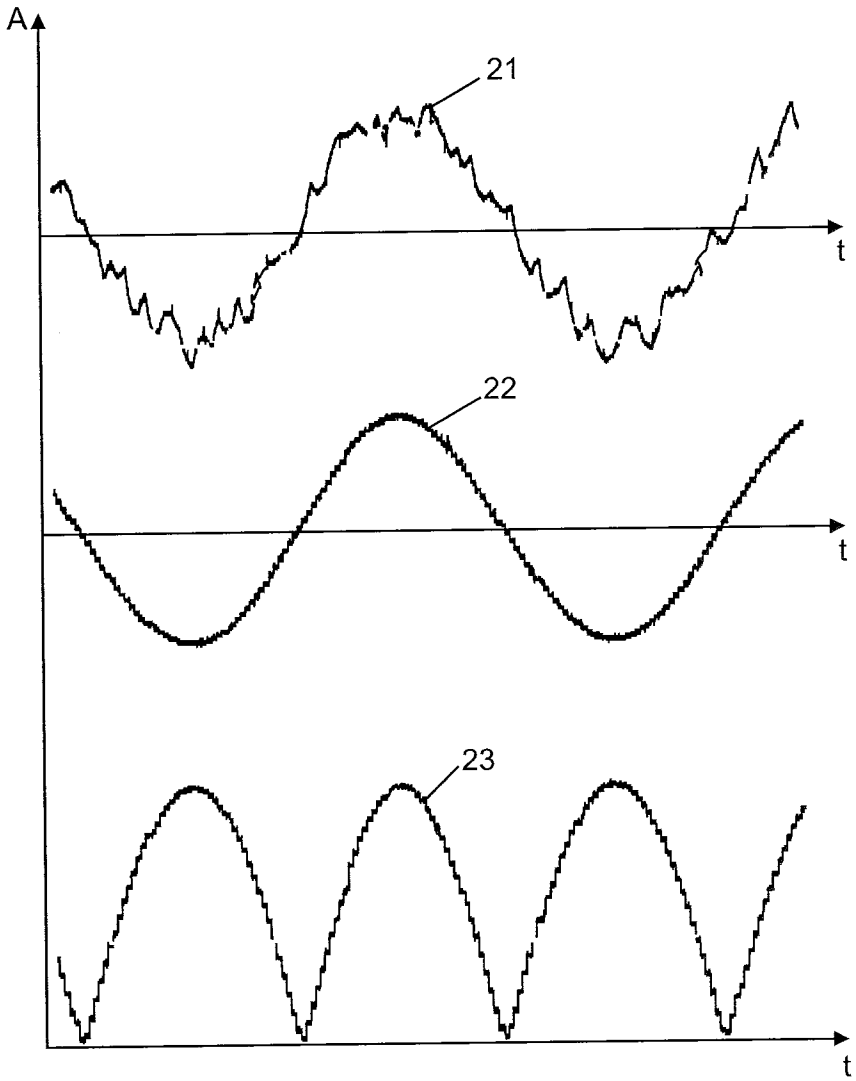
FIG. 5 shows a schematic diagram of the voltage profile of the mains voltage and a modelled voltage profile of the mains voltage or the rectified AC voltage.

FIG. 5 depicts a diagram having three signal profiles, wherein time t is plotted on the X-axis and an amplitude A is plotted on the Y-axis. The real voltage profile 21 of the mains voltage is depicted on the first line. It is apparent from the graph that this mains voltage is distorted by spikes and other small disturbances, so that a control of the circuit states I, II, III of the LED light unit 7 could also result in disturbances in the light emission of the LED light unit 7 based on the real voltage profile 21.

The modelled voltage profile 22 of the mains voltage is depicted on the line below, wherein it is apparent that most of the disturbances have been eliminated via modelling. In the third line, the modelled voltage profile 23 of the rectified AC voltage is shown, which may be produced by folding the modelled voltage profile 22 of the AC voltage. Both the modelled voltage profile 22 and the modelled voltage profile 23 may be used as a reference value of the control device 8. However, unlike the conventional filters, the modelling does not result in a time offset; the curves 21 and 22 or 23 run synchronously to each other in real time.

LIST OF REFERENCE NUMBERS

1 Lighting device
2 AC power supply
3 Connection interface
4 Mains filter
5 Rectifier
6 Current sink device

7 LED light unit
8 Control device
9 Circuit arrangement
10 *a, b, c, d* LED subgroups
11 Supply voltage
12 Short-circuit switching device
13 Modelling device
14 *a, b* Measuring points
15 *a, b* Conductors
16 *a, b* Analogue-digital interfaces
17 Interface
18 Oscillator module
19 Calculation module
20 Correction module
21 Real voltage profile
22 Modelled voltage profile
23 Modelled voltage profile
24 Digital data processing device
25 Space vector
26 *a, b* Signal profiles
A Amplitude
t Time

What is claimed is:

1. An LED lighting device, wherein the LED lighting device is configured to be supplied with a main voltage by an AC power supply, comprising:

a rectifier device for producing a rectified AC voltage from the main voltage, an LED light unit, wherein the LED light unit comprises a plurality of LEDs and a circuit arrangement, wherein the circuit arrangement is configured to switch the LEDs to different circuit states, wherein the LED light unit has different forward voltages in the different circuit states, a control device for controlling the circuit arrangement, wherein the control device is configured to control the circuit arrangement in such a way that the forward voltage of the LED light unit is adjusted to the voltage profile of the rectified AC voltage, and a modelling device for modelling a modelled voltage profile, wherein the control device is configured to control the circuit states based on the modelled voltage profile, wherein the modelled voltage profile is modelled based on measured variables for describing the real voltage profile of the main voltage.

2. The LED lighting device according to claim 1, further comprising a digital data processing device, wherein the modelling device is configured as a program.

3. The LED lighting device according to claim 2, further comprising two analogue-digital interfaces, wherein each of the analogue-digital interfaces is connected to a conductor of the main voltage, and the tapped measured values jointly form the signal profile of the real voltage profile of the main voltage.

4. The LED lighting device according to claim 3, further comprising an additional rectifier device, wherein the two analogue-digital interfaces are connected to the conductors of the main voltage and wherein the analogue-digital interfaces measure the signal value in relation to a reference potential downstream of the additional rectifier device.

5. The LED lighting device according to claim 1, wherein the modelling device comprises a calculation module for calculating an actual phase angle and a voltage amplitude of the real voltage profile of the main voltage.

6. The LED lighting device according to claim 5, wherein the calculation module is configured as a space vector module having a space vector, wherein the space vector is formed from a first signal profile and a second signal profile, wherein the two signal profiles are offset from each other by a phase angle.

7. The LED lighting device according to claim 6, wherein the first signal profile is formed as the real voltage profile of the main voltage, and the second signal profile is formed as the first signal profile offset by 90°.

8. The LED lighting device according to claim 5, wherein the modelling device comprises an oscillator module for producing the modelled voltage profile.

9. The LED lighting device according to claim 8, wherein the modelling device comprises a correction module which is configured to compare the phase angle of the modelled voltage profile with the actual phase angle, and as a result of the comparison, to produce an error signal and to feed the error signal back to the oscillator module.

10. The LED lighting device according to claim 1, further comprising a current sink device for controlling the LED current through the LED light unit, wherein the current sink device is connected in series to the LED light unit, wherein the control device controls the current sink device in such a way that the LED current through the LED light unit is adjusted to an instantaneous value of the modelled voltage profile.

11. The LED lighting device according to claim 1, wherein the control device controls the LED light unit in such a way that a circuit state is activated having a forward voltage, wherein the forward voltage is less than or equal to the instantaneous value of the modelled voltage profile.

12. The LED lighting device according to claim 1, wherein the circuit state is activated which has the highest forward voltage, which is less than or equal to the instantaneous value of the modelled voltage profile.

* * * * *